US005366571A

United States Patent [19]

Ruhe et al.

[11] Patent Number: 5,366,571

[45] Date of Patent: Nov. 22, 1994

[54] HIGH PRESSURE-RESISTANT NONINCENDIVE EMULSION EXPLOSIVE

[75] Inventors: Thomas C. Ruhe, Duquesne, Pa.; Pilaka P. Rao, Baghlingampalli, India

[73] Assignee: The United States of America as represented by the Secretary of the Interior, Washington, D.C.

[21] Appl. No.: 2,860

[22] Filed: Jan. 15, 1993

[51] Int. Cl.[5] ..... C06B 31/28; C06B 45/00; C06B 29/08

[52] U.S. Cl. ..... 149/2; 149/46; 149/36; 149/61; 149/77; 149/83

[58] Field of Search ..... 149/2, 46, 60, 61, 62, 149/77, 83

[56] References Cited

U.S. PATENT DOCUMENTS

| | | | |
|---|---|---|---|
| 3,161,551 | 12/1964 | Egly et al. | 149/46 |
| 3,447,978 | 6/1969 | Bluhm et al. | 149/21 |
| 3,674,578 | 7/1972 | Cattermole et al. | 149/47 |
| 3,765,964 | 10/1973 | Wade | 149/2 |
| 4,110,134 | 8/1978 | Wade | 149/2 |
| 4,218,272 | 8/1980 | Brockington | 149/21 |
| 4,315,787 | 2/1982 | Hattori et al. | 149/2 |
| 4,326,900 | 4/1982 | Hattori et al. | 149/2 |
| 4,398,976 | 8/1983 | Hattori et al. | 149/21 |
| 4,414,044 | 11/1983 | Takeuchi et al. | 149/2 |
| 4,543,136 | 9/1985 | Edamura et al. | 149/21 |
| 4,543,137 | 9/1985 | Edamura et al. | 149/21 |
| 4,547,232 | 10/1983 | Cartwright | 149/2 |
| 4,555,278 | 11/1985 | Cescon et al. | 149/21 |
| 4,585,495 | 4/1986 | Honeyman et al. | 149/2 |
| 4,585,496 | 4/1986 | Honeyman et al. | 149/21 |
| 4,664,729 | 5/1987 | Rehman | 149/21 |
| 4,708,753 | 11/1987 | Forsberg | 149/2 |
| 4,732,626 | 3/1988 | Edamura et al. | 149/21 |
| 4,940,497 | 7/1990 | Van Ommeren | 149/2 |
| 4,960,475 | 10/1990 | Cranney et al. | 149/2 |
| 4,992,118 | 2/1991 | Peng et al. | 149/2 |
| 4,993,028 | 2/1991 | Hills | 371/39.1 |
| 4,995,925 | 2/1991 | Engsbraten | 149/2 |
| 4,997,495 | 3/1991 | Young | 149/2 |
| 5,000,802 | 3/1991 | Ikeda et al. | 149/2 |
| 5,244,475 | 9/1993 | Lownds et al. | 44/271 |

FOREIGN PATENT DOCUMENTS 237274 9/1987 European Pat. Off. .

OTHER PUBLICATIONS

Ruhe, Thomas C., and Wieland, Michael S; "Rugged Emulsion Formulation #37–Candidate Permissible"; presented to Society of Explosive Engineers 18th Annual Conference on Explosives & Blasting Techniques; Orlando, Fla.; Jan. 19, 1992.

Wieland, Michael S; "The Laboratory Determination of Dynamic Resistance of Cap–Sensitive Explosives"; 1990 SEE Conference; Orlando, Fla.; Feb. 4–9, 1990.

Edmura, Koji and Saki, Hiroshi; "Water–in–Oil Emulsion Composition"; Chemical Abstracts, vol. 108, No. 4, dated Jan. 25, 1988; 108:24191n.

*Primary Examiner*—Donald P. Walsh
*Assistant Examiner*—Anthony R. Chi
*Attorney, Agent, or Firm*—E. Philip Koltos

[57] ABSTRACT

An improved emulsion explosive composition including hollow microspheres/bulking agents having high density and high strength. The hollow microspheres/bulking agents have true particle densities of about 0.2 grams per cubic centimeter or greater and include glass, siliceous, ceramic and synthetic resin microspheres, expanded minerals, and mixtures thereof. The preferred weight percentage of hollow microspheres/bulking agents in the composition ranges from 3.0 to 10.0 A chlorinated paraffin oil, also present in the improved emulsion explosive composition, imparts a higher film strength to the oil phase in the emulsion. The emulsion is rendered nonincendive by the production of sodium chloride in situ via the decomposition of sodium nitrate, a chlorinated paraffin oil, and sodium perchlorate. The air-gap sensitivity is improved by the in situ formation of monomethylamine perchlorate from dissolved monomethylamine nitrate and sodium perchlorate.

The emulsion explosive composition can withstand static pressures to 139 bars and dynamic pressure loads on the order of 567 bars.

20 Claims, No Drawings

HIGH PRESSURE-RESISTANT NONINCENDIVE EMULSION EXPLOSIVE

TECHNICAL FIELD

The present invention relates to a water-in-oil emulsion explosive composition and more particularly to a water-in-oil emulsion explosive containing hollow-microspheres/bulking agents of high density and strength and alone or together with a chlorinated paraffin oil additive having an enhanced pressure-resistance against static and dynamic pressure desensitization. The explosive can also contain nonincendive agents, i.e., chemical compounds containing sodium and chlorine, which reduce its incendivity. Furthermore, the air-gap sensitivity is enhanced by the inclusion of sensitizers, such as monomethylamine nitrate and sodium perchlorate.

BACKGROUND ART

The term dead-pressing is commonly used to describe both static and dynamic pressure effects. However, technically dead-pressing applies only to relatively slow or steady static compression effects. These can be produced by a hydraulic press, as in the original meaning, by immersion of the explosive in water-hydrostatic head pressure, application of compressed air, or mechanical "squeezing" due to the mass of rock surrounding an explosive-tectonic pressure. Conversely, dynamic pressurization is a very rapid transient phenomenon induced by shock waves or pressure pulses produced by adjacent bore hole explosions during delay blasting operations. The term "pressure desensitization" is used herein to cover both static and dynamic effects. Both can have the same effect on the explosive-reduced performance or failure.

The term nonincendive explosive means one that will not cause the ignition of flammable atmospheres that can be present in underground mines. A nonincendive explosive can be classified as a Permissible if it passes the required tests and is approved [as per U.S. Code of Federal Regulations (CFR). Title—30 Mineral Resources; Chapter 1—Mine Safety Health Administration (MSHA), Dept. of Labor; Subchapter B—Testing, Evaluation, and Approval of Mining Products, Part 15—Requirements for Approval of Explosives and Sheathed Explosive Units, Jul. 1, 1990, pp. 89–96]. These tests are performed by the US Bureau of Mines. Incendivity—Gallery tests numbers 7 & 8 incorporate flammable atmospheres consisting of 8% natural gas/air and 4% natural gas-coal dust/air mixtures respectively. In test 7, the Bruceton up-and-down statistical method, is used to determine $W_{50}$ (charge weight for a 50% probability of ignition) to $L_{95}$ (lower limit for 95% confidence). The minimum $W_{50}$ passing level is 450 g to 95%. In test 8 the minimum passing level is a $W_{cdg}$ (weight of explosive in coal dust and gas) of 350 g for which there is a 50% probability of ignition.

The Air-Gap Sensitivity test (explosion by influence test) evaluates the ability of a candidate explosive to propagate detonation across a gap between adjacent explosive cartridges. The minimum allowable air-gap is 7.6 cm (3 in) at an explosive temperature of 25°±5° C. (77°±9° F.), and 5.1 cm (2 in) at 5° C.

Other tests are also required to establish permissibility.

Several emulsion explosive compositions described in the prior art utilized various types of microspheres/-bulking agents such as glass microballoons, plastic microspheres, perlites, expanded minerals, cushioning medium of structural foam, and chemical gassing agents to control the density of the emulsion and also to impart sensitivity. These emulsion explosive formulations disclosed in various patents claim several improvements in performance, such as high stability, good initiation sensitivity, good cold temperature sensitivity, and high detonation pressure. However, these compositions of the prior art do not perform satisfactorily when subjected to high static and/or dynamic pressures. These emulsion explosives often fail to detonate due to dead-pressing phenomenon, caused by shock waves of adjacent bore hole explosions during delay blasting operations.

Most nonincendive (permissible) explosives of prior art add sodium chloride directly, as the primary nonincendive agent. However, the direct addition of sodium chloride (in dissolved or suspended form) to an emulsion explosive can severely reduce the air-gap sensitivity and in some cases make it not cap sensitive.

Previous emulsion explosives added monomethylamine nitrate to improve air-gap sensitivity.

Those concerned with these and other problems recognize the need for an improved high pressure-resistant emulsion explosive composition.

DISCLOSURE OF THE INVENTION

The present invention provides an improved emulsion explosive composition including hollow microspheres/bulking agents having high density and high strength.

The hollow microspheres/bulking agents that have been discovered to be suitable for purposes of the present invention have true particle densities of about 0.2 grams per cubic centimeter or greater, and include materials selected from the group consisting of glass, siliceous, ceramic and synthetic resin microspheres, expanded minerals, and mixtures thereof. The preferred weight percentage of hollow microspheres/bulking agents in the compositions of the present invention ranges from 3.0 to 10.0.

The present invention also provides for the inclusion of a chlorinated paraffin oil, preferably containing 5 to 70% chlorine in the composition within the range of up to 0 to about 10% by total weight of the explosive composition.

In addition, the present invention provides for the incorporation of the sodium-containing agents and chlorine-containing agents, such as those selected from the group consisting of sodium nitrate, sodium perchlorate, and chlorinated paraffin oil.

Also, the present invention provides for the incorporation of auxiliary sensitizers, such as monomethylamine nitrate, into the explosive composition.

The emulsion explosive compositions, produced in accordance with the present invention can withstand static pressures to 139 bars and dynamic pressure loads to 567 bars, and composition 5 in table 1 is nonincendive.

An object of the present invention is the provision of an improved high pressure-resistant emulsion explosive composition.

Another object is to provide an emulsion explosive composition that is nonincendive in flammable atmospheres, and passes the permissibility incendivity requirements.

An additional object is to provide an emulsion explosive composition that passes the air-gap requirements for permissibility.

Another object is to provide an emulsion explosive composition that maximizes safety in commercial blasting operations.

A further object of the invention is the provision of an emulsion explosive composition that inhibits emulsion explosive malfunctioning caused by pressure desensitization phenomenon.

Still another object is to provide an emulsion explosive composition that withstands higher pressure impaction and still functions normally.

These and other attributes of the invention will become more clear upon a thorough study of the disclosure of the invention presented herein, including the following description of the best mode for carrying out the invention, particularly when reviewed in conjunction with the examples.

The improved emulsion explosive composition of the present invention is produced by the following procedure:

According to the weight percent compositions specified in Table 1 and a 3000 gram batch size, the ingredients are weighed into 3 containers. The water plus salts, e.g., ammonium nitrate, sodium, nitrate, sodium perchlorate, and monmethylamine nitrate are added to a 3 liter stainless steel beaker which is heated to 90° C. in a boiling water bath, then to 105°–115° C. on an electric hot plate. The mixture is stirred to obtain a clear solution. The most preferred temperature at the time of pouring this oxidizer solution, i.e., the water phase is 110° C.

The second container (a half liter beaker) holding the oil phase ingredients, i.e., waxes, oils, and sorbitan monooleate is heated in a boiling water bath to 90°–110° C. This mixture is stirred until all the components have melted. The most preferred pouring temperature is 95° C. The third container holds the hollow microspheres or perlite, i.e., the external phase.

The 3 phases are combined to form the finished emulsion explosive in a 4 liter stainless steel bowl of a planetary mixer equipped with a wire whip stirring blade. The bowl is preheated by a hot air blower to 90° C.–100° C., and substantially all of the oil phase is added essentially at the same time. The mixer is adjusted to a slow speed and the water phase is poured in a thin steam. The speed is gradually increased to provide the maximum mixing action, without excessive splashing, over a 5 to 10 minute pouring interval. Then, additional mixing is done at full speed for 1 to 2 minutes.

At this point the emulsion, which is insensitive, is fully formed. However, it does not become a sensitive emulsion explosive until the addition of the microspheres of the external phase. The microspheres or perlite, preferably in the form of a fine dry powder, are initially incorporated by hand mixing (until fully wetted), then stirred with the electric mixer for an additional 15 seconds. At this point, the finished emulsion explosive is packaged before it cools to room temperature.

BEST MODE FOR CARRYING OUT THE INVENTION

The following examples are illustrative of the best mode for carrying out the invention. They are obviously not to be construed as limitative of the invention since various other embodiments can readily be evolved in view of the teachings provided herein.

The best mode for producing the emulsion compositions uses the weight percents of the ingredients listed in table 1, with a 3000 gram batch size. The nitrates and perchlorates are dissolved in the water and heated to 110° C. The waxes, oils, and monooleate are heated and melted together in a separate beaker to 95° C. This oil phase is poured into a 4 liter stainless steel bowl (preheated to 95° C.) of a planetary mixer. While the mixer speed is gradually increased, the water solution is poured in a thin stream, and completely added within 10 minutes. The perlite or microspheres are then stirred in by hand until fully wetted, and finally stirred at full speed with the electric mixer for an additional 15 seconds.

This present invention provides improved pressure-resistant emulsion explosive compositions by the inclusion of a specific type of hollow microsphere/bulking agent having high density and high strength, and a chlorinated paraffin oil which gives additional pressure resistance by imparting higher film strength to the oil phase in the emulsion explosive.

In contrast to the prior art wherein light, low density microspheres/bulking agents are included in the emulsion explosive compositions, the present invention is directed to including high density and high-strength microspheres/bulking agents in the compositions in order to accomplish superior performance under static and dynamic pressure conditions. Preferably, a chlorinated paraffin oil is included in the emulsion explosive compositions of the present invention, In accordance with the present invention, improved pressure-resistant emulsions are provided that can withstand static pressures up to 139 bars and dynamic pressure loads on the order of 567 bars by the inclusion of high-density hollow microspheres/bulking agents obtained from glass, silica, alumina, volcanic rock, expanded minerals, coated perlites, uncoated perlites, and synthetic resin microspheres obtained from phenolic resin, polyvinyledene chloride, epoxy resin, and the like. The microspheres/bulking agents are used alone or in admixture. A preferred group of high-density hollow microspheres/bulking agents for purposes of the present invention include materials selected from the group consisting of glass microspheres, siliceous microspheres, ceramic microspheres, expanded materials, synthetic resin microspheres, and mixtures thereof.

The present invention also provides enhanced air-gap sensitivity by the inclusion of sodium-containing compounds and chlorine-containing compounds to impart nonincendive performance, and/or the inclusion of monomethylamine nitrate and sodium perchlorate.

In contrast, to most nonincendive (permissible) explosives of prior art wherein sodium chloride is added directly as the primary nonincendive agent, the present invention involves producing sodium chloride in situ via the thermal decomposition of other chemical compounds containing sodium and/or chlorine, during explosive combustion and in the detonation process.

Although not wishing to be bound by any particularly theory, it is believed that sodium and chlorine free radicals can form and help to inhibit the ignition of a local flammable atmosphere. Sources of sodium and chlorine include sodium nitrate, chlorinated paraffin oil, such as Chlorowax® 100 (registered trademark of the Occidental Chemical Corp), and sodium perchlorate.

Related to this, it has been discovered that sodium chloride produced in situ does not degrade the air-gap sensitivity or cap sensitivity of the emulsion explosive, as does wholly added sodium chloride when dissolved in the water phase premix before the emulsion is formed or added externally after the emulsion is formed, but before the finished emulsion explosive is packaged.

In contrast, to conventional use of monomethylamine nitrate to improve air-gap sensitivity of permissible emulsion explosives, the present invention involves dissolving monomethylamine nitrate in common with sodium perchlorate such that the two can interact via ion exchange in situ to form an even more sensitive species, i.e. monomethylamine perchlorate. Although previous emulsion explosives added monomethylamine nitrate to improve air-gap sensitivity, it has been discovered that an additional sensitizer, such as sodium perchlorate is needed to produce a significant improvement in the air-gap sensitivity. Related to this, it has been discovered that monomethylamine perchlorate produced in situ by the combination of monomethylamine nitrate and sodium perchlorate enhances the air-gap sensitivity more than monomethylamine nitrate or sodium perchlorate alone, and that emulsion explosive composition example 5 in table 1 passes the air-gap test for permissibility (at 26° and 5° C.).

In the preferred embodiment of the present invention, the hollow microspheres/bulking agents are preferably selected from the group consisting of glass microspheres having true particle density in the range of 0.2 to 0.4 grams per cubic centimeter; siliceous and ceramic hollow microspheres having true particle density of 0.2 to 0.7; phenolic microspheres having a density in the range of 0.2 to 0.3 grams per cubic centimeter; and expanded minerals including coated perlites and uncoated perlites having high strength. The preferred weight percentage range of the hollow microspheres/bulking agents is 3–10. The hollow microspheres/bulking agents can be used alone or in admixture.

In the preferred embodiment, the chlorinated paraffin can be a liquid or a solid, containing up to about 70% by weight chlorine. The preferred weight % range is 0–10.

The improved cap-sensitive, pressure resistant nonincendive emulsion of the subject invention comprises 1 to 15% of hollow microspheres/bulking agents; from about 0 to 30% of organic nitrates; from about 10 to 90% of inorganic nitrates; from 4 to 20% water; from about 0.2 to 5% of an emulsifier; from 2 to 20% of carbonaceous fuels; from about 0 to 10 chlorinated paraffin oil; from about 0 to 20% inorganic perchlorates; from about 0 to 20% auxiliary sensitizers and from 0 to 20% additional fuels. The said percentages are based on the weight of the final emulsion composition.

EXAMPLES

The following examples, the compositions of which are tabulated in Table 1, are presented to further illustrate the present invention, and not to limit the invention except as it is limited by the claims. All percentages are by weight unless specified.

EXAMPLES 1–5

The composition of Examples 1–5 tabulated in Table 1, were prepared as follows. According to the weight percent compositions specified in Table 1 and a 3000 gram batch size, the ingredients are weighed into 3 containers. The water plus salts, e.g., ammonium nitrate, sodium, nitrate, sodium perchlorate, and monmethylamine nitrate are added to a 3 liter stainless steel beaker which is heated to 90° C. in a boiling water bath, then to 105°–115° C. on an electric hot plate. The mixture is stirred to obtain a clear solution. The most preferred temperature at the time of pouring this oxidizer solution, i.e., the water phase is 110° C.

The second container (a half liter beaker) holding the oil phase ingredients, i.e., waxes, oils, and sorbitan monooleate is heated in a boiling water bath to 90°–110° C. This mixture is stirred until all the components have melted. The most preferred pouring temperature is 95° C. The third container holds the hollow microspheres or perlite, i.e., the external phase.

The 3 phases are combine to form the finished emulsion explosive in a 4 liter stainless steel bowl of a planetary mixer equipped with a wire whip stirring blade. The bowl is preheated by a hot air blower to 90°–100° C., and substantially all of the oil phase is added essentially all at the same time. The mixer is adjusted to a slow speed and the water phase is poured in a thin steam. The speed is gradually increased to provide the maximum mixing action, without excessive splashing, over a 5 to 10 minute pouring interval. Then, additional mixing is done at full speed for 1 to 2 minutes. The microspheres or perlite, preferably in the form of a fine dry powder, are initially incorporated by hand mixing (until fully wetted), then stirred with the electric mixer for an additional 15 seconds. At this point, the finished emulsion explosive is packaged before it cools to room temperature.

TABLE 1

COMPOSITIONS AND PROPERTIES OF THE EMULSION EXPLOSIVES OF THE PRESENT INVENTION

| | 1 | 2 | 3 | 4 | 5 |
|---|---|---|---|---|---|
| Ammonium Nitrate | 64.5 | 61.5 | 62 | 63.5 | 47 |
| Sodium Nitrate | 5 | 5 | 5 | 5 | 12 |
| Sodium Perchlorate | 10 | 10 | 10 | 10 | 5 |
| Monomethylamine Nitrate | — | — | — | — | 15 |
| Water | 12 | 12 | 12 | 12 | 8.5 |
| Paraffin Wax | 3 | 3 | 3 | 3 | 1 |
| Paraffin Oil | 1 | 1 | 1 | 1 | — |
| Chlorowax ® 100 | — | — | — | — | 4 |
| Sorbitan monooleate | 1.5 | 1.5 | 1.5 | 1.5 | 1.5 |
| Hollow microspheres/ Bulking Agents | | | | | |
| $E_{22/400}$ glass microspheres | 3 | — | — | — | — |
| $B_{28/750}$ glass microspheres | — | 6 | — | — | 6 |
| $B_{37/2000}$ glass microspheres | — | — | 4 | — | — |
| $C_{15/250}$ glass microspheres | — | — | 1.5 | — | — |
| Dicaperl Coated Perlite | — | — | — | 4 | — |
| Density (g/cc) | 1.14 | 1.15 | 1.10 | 1.14 | 1.13 |
| Detonation Velocity (m/sec) | 5700 | 5060 | 4790 | 4350 | 5210 |
| Static Pressure Resistance (bars) | 63 | 84 | 63 | 139 | 129 |
| Dynamic Pressure Resistance (Bars) | 179 | 236 | — | 478 | 567 |

[1]Chlorowax ® is a registered trademark of the Occidental Chemical Corp.

Example emulsion explosive composition #5 in table 1 passed incendivity gallery test 7 with a $W_{50}$ value of 624 g, and test 8 with a $W_{cdg}$ value of 944 g. This emulsion explosive also passed the air-gap test with a minimum value of 8.9 cm (3.5 in) at 26° C. and 10.2 cm (4 in) at 5° C.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

We claim:

1. An emulsion explosive composition having improved sympathetic deterioration capability and enhanced pressure resistance against static and dynamic pressure desensitization caused by shooting other explosive charges in adjacent boreholes in mines, comprising:

high density, high strength hollow microspheres/-bulking agents present in the composition in amounts ranging from 1.0 to 15.0 weight percent;

inorganic nitrates selected from the group consisting of sodium nitrate, ammonium nitrate and calcium nitrate present in the composition in amounts ranging from about 10.0 to about 90.0 weight percent;

organic nitrate selected from the group consisting of monomethylamine nitrate, monoethylamine nitrate and hydrazine nitrate present in the composition in amounts ranging from 1.0 to 30.0 weight percent;

water present in the composition in amounts ranging from about 4.0 to about 20.0 weight percent;

an emulsifier present in the composition in amounts ranging from about 0.2 to about 5.0 weight percent;

hydrocarbon fuels present in the composition in amounts ranging from about 2.0 to about 10.0 weight percent; and chlorinated paraffin oil present in the composition in amounts ranging from 1.0 to 20.0 weight percent.

2. The composition of claim 1 further comprising sodium perchlorate present in the composition in amounts ranging from 1.0 to 20.0 weight percent.

3. The composition of claim 1 further comprising auxiliary sensitizers present in the composition in amounts ranging from 1.0 to 20.0 weight percent.

4. The composition of claim 1 further comprising additional fuels present in the composition in amounts up to about 20.0 weight percent.

5. The composition of claim 2 further comprising auxiliary sensitizers present in the composition in amounts ranging from 1.0 to 20.0 weight percent.

6. The composition of claim 5 further comprising additional fuels present in the composition in amounts up to about 20.0 weight percent.

7. The composition of claim 1 wherein the hollow microspheres/bulking agents have a true particle density of about 0.2 grams per cubic centimeter or higher.

8. The composition of claim 7 wherein the hollow microspheres/bulking agents comprise glass microspheres having a true particle density in the range of 0.2 to 0.4 grams per cubic centimeter.

9. The composition of claim 7 wherein the hollow microspheres/bulking agents comprise siliceous hollow microspheres having a true particle density in the range of 0.2 to 0.7 grams per cubic centimeter.

10. The composition of claim 7 wherein the hollow microspheres/bulking agents comprise ceramic hollow microspheres having a true particle density in the range of 0.2 to 0.7 grams per cubic centimeter.

11. The composition of claim 7 wherein the hollow microspheres/bulking agents comprise expanded minerals.

12. The composition of claim 11 wherein the expanded minerals comprise uncoated perlites.

13. The composition of claim 11 wherein the expanded minerals comprise coated perlites.

14. The composition of claim 7 wherein the hollow microspheres/bulking agents comprise phenolic microspheres having a true particle density in the range of 0.2 to 0.3 grams per cubic centimeter.

15. The composition of claim 1 wherein the hollow microspheres/bulking agents are present in the composition in amounts ranging from 3.0 to 10.0 weight percent.

16. The composition of claim 7 wherein the hollow microspheres/bulking agents are present in the composition in amounts ranging from 3.0 to 10.0 weight percent.

17. The composition of claim 7 wherein the hollow microspheres/bulking agents are selected from a group consisting of glass microspheres, siliceous microspheres, ceramic microspheres, expanded minerals, synthetic resin microspheres, and mixtures thereof.

18. The composition of claim 1 wherein the chlorinated paraffin comprises 5.0 to 70.0 weight percent chlorine, and is in a form selected from the group consisting of a liquid and a solid.

19. The composition of claim 1 wherein the emulsion explosive composition is nonincendive.

20. The composition of claim 19 wherein sodium chloride produced in situ when said emulsion explosive composition is ignited.

* * * * *